US007847706B1

(12) United States Patent
Ross et al.

(10) Patent No.: US 7,847,706 B1
(45) Date of Patent: Dec. 7, 2010

(54) WIRELESS ELECTRICAL APPARATUS CONTROLLER DEVICE AND METHOD OF USE

(75) Inventors: Allan L. Ross, San Diego, CA (US); William D. McWhirter, Mason, OH (US); John S. Weaver, Cincinnati, OH (US); Paul R. Jordan, Blanchester, OH (US)

(73) Assignee: Wireless Telematics LLC, La Jolla, CA (US)

( * ) Notice: Subject to any disclaimer, the term of this patent is extended or adjusted under 35 U.S.C. 154(b) by 576 days.

(21) Appl. No.: 10/875,140

(22) Filed: Jun. 23, 2004

(51) Int. Cl.
*G08C 19/00* (2006.01)

(52) U.S. Cl. ..... 340/825.69; 340/5.1; 340/5.61

(58) Field of Classification Search ..... 340/825.69, 340/825.72, 825.22, 5.61, 5.64, 5.74, 5.1, 340/7.1, 825.29; 315/312, 314, 315; 341/176; 700/296

See application file for complete search history.

(56) References Cited

U.S. PATENT DOCUMENTS

| | | | | |
|---|---|---|---|---|
| 4,368,408 | A * | 1/1983 | Marcus | 340/309.8 |
| 4,454,509 | A | 6/1984 | Buennagel et al. | |
| 5,040,331 | A * | 8/1991 | Merendino et al. | 49/25 |
| 5,165,465 | A * | 11/1992 | Kenet | 165/11.1 |
| 5,254,908 | A | 10/1993 | Alt et al. | |
| 5,477,228 | A * | 12/1995 | Tiwari et al. | 342/357.03 |
| 5,661,468 | A * | 8/1997 | Marcoux | 340/7.1 |
| 5,805,530 | A * | 9/1998 | Youngberg | 368/47 |
| 5,859,595 | A * | 1/1999 | Yost | 340/7.38 |
| 6,108,614 | A * | 8/2000 | Lincoln et al. | 702/183 |
| 6,204,615 | B1 | 3/2001 | Levy | |
| 6,236,331 | B1 | 5/2001 | Dussureault | |
| 6,236,332 | B1 * | 5/2001 | Conkright et al. | 340/3.1 |
| 6,374,101 | B1 * | 4/2002 | Gelbien | 455/420 |
| 6,788,218 | B2 * | 9/2004 | Sudolcan | 340/870.16 |
| 6,873,573 | B2 * | 3/2005 | Pikula et al. | 368/10 |
| 6,876,670 | B1 * | 4/2005 | Budrikis et al. | 370/474 |
| 7,006,006 | B2 * | 2/2006 | Witkow et al. | 340/825.25 |
| 2002/0169539 | A1 * | 11/2002 | Menard et al. | 701/200 |
| 2003/0222587 | A1 | 12/2003 | Dowling, Jr. et al. | |

FOREIGN PATENT DOCUMENTS

| | | | |
|---|---|---|---|
| EP | 1 074 441 | A1 | 3/2000 |
| EP | 1 251 721 | A1 | 10/2002 |
| WO | WO 03/043384 | A1 | 5/2003 |

* cited by examiner

*Primary Examiner*—Vernal U Brown
(74) *Attorney, Agent, or Firm*—Mind Law Firm; Jeromye V. Sartain; Justin G. Sanders

(57) ABSTRACT

A device for controlling one or more electrical apparatuses comprising a processor/transceiver control unit connected to each electrical apparatus and having at least one microprocessor wired to a transceiver and a clock circuit that keeps real-time onboard, the microprocessor storing an operating protocol according to which the control unit controls power to the electrical apparatus at real-time as kept by the clock circuit. The control unit's microprocessor may be further configured to read and store a nominal voltage for the electrical apparatuses and to compare the nominal voltage to the electrical apparatuses' operating voltage so as to monitor and report on their operation.

29 Claims, 5 Drawing Sheets

WIRELESS ELECTRICAL APPARATUS CONTROLLER DEVICE AND METHOD OF USE

INCORPORATION BY REFERENCE

Applicants hereby incorporate herein by reference any and all U.S. patents and U.S. patent applications cited or referred to in this application.

BACKGROUND OF THE INVENTION

1. Field of the Invention

Aspects of this invention relate generally to electrical apparatus controllers, and more particularly to wireless electrical apparatus control devices.

2. Description of Related Art

The following art defines the present state of this field:

U.S. Pat. No. 4,454,509 to Buennagel et al. is directed to a load management system which includes a central message generator and a plurality of addressable remote load controllers which selectively connect and disconnect high power deferrable loads to and from a power source in response to transmitted messages. The load controllers include means for translating coded tone pair inputs into digital data. Tones selected from three such tone pairs are used in one scheme, where a tone selected from the first tone pair is used for the initial bit of a message, and subsequent tones are alternately selected from the remaining two tone pairs or the remaining bits. One of the tones of the first tone pair is utilized as a test tone which initiates a test routine sequence. The test tone can be transmitted by a portable, low power transmitter to test the functioning of the remote units. A message format includes two code sets, a zone code set and a command/address code set. Each load controller has a preprogrammed zone identifier and a preprogrammed address identifier, and is responsive to a command/address code message only when the last received zone code message has identified the preprogrammed zone identifier of that load controller and the command/address message indicates the preprogrammed address identifier of that load controller. All load controllers having a common zone identifier are responsive to a scram instruction message which identifies that zone.

U.S. Pat. No. 5,254,908 to Alt et al. is directed to a sign board lighting control system for remotely controlling the lighting of a plurality of sign boards which includes a radio transmitting device at a central location, and a radio receiving device and a lighting control unit at each sign board location. During set-up of a sign board, programming signals designating the mode of operation and the location of the sign board are transmitted by radio to the control unit associated with each sign board. Subsequently, timing signals containing a multiple-digit computer generated code designating the time of day and the time of sunrise and sunset on a particular day within particular latitudinal zones are transmitted by radio to the control units of all sign boards. Each lighting control unit interprets and responds to the timing signals in accordance with previously received programming signals to control the illumination of the sign board in accordance with a predetermined lighting protocol.

U.S. Pat. No. 5,661,468 to Marcoux is directed to a system for remote control of electrical load devices, particularly electrical lighting where the commands are broadcast over a radio pager system. A radio pager receiver is located within or nearby the electrical light fixture and is normally in a standby state, receives the commands broadcast. The radio pager receiver is connected to a computer processor and electronic circuitry. The computer processor interprets the commands and instructs the electronic circuitry to perform a desired operation. These operations include but are not limited to turning an electrical light element or group of electrical light elements on or off, dimming the light element or reprogramming the electrical light element to be included in a different control group of lights. Before the operation is accomplished, the computer processor checks for the appropriate security code entry. In addition, there are protection mechanisms built into the computer processor so that if the decoding of the commands indicates that a large block of devices is to be turned on at the same time, the operation will be staggered so as to prevent a huge inrush of current. One preferred embodiment of this device is to be installed in a typical exterior roadway light fixture.

U.S. Pat. No. 5,936,362 to Alt et al. is directed to a control system for remotely controlling the application of electric power to a plurality of electric apparatuses includes a radio transmitting device at a central location, and a radio receiving device and a control unit at each electrical apparatus location. Programming signals designating the operating protocol or mode and the location of the electrical apparatus are transmitted by a radio programming signal to the control unit associated with each electrical apparatus. Subsequently, timing reference signals are transmitted to the control units of all electrical apparatus. Each control unit interprets and responds to the timing signals in accordance with previously received programming signals to control the application of electric power to the electrical apparatus in accordance with a predetermined operating protocol.

European Patent Application Publication No. EP 1 074 441 to Baldenweck is directed to a remote car function control unit having a broadcast message receiver using GSM signals with receiver set using position finding satellite information and setting processor unit. The remote control function setting unit has a broadcast message receiver system setting an information server. There is a position finding system (GPS) determines local position providing messages to a processor unit commanding messages from a GSM system.

U.S. Pat. No. 6,204,615 to Levy is directed to a new and improved outdoor lighting control system for an outdoor lighting system network for automatically sensing, conveying, and recording data relevant to the operation of the lighting system network so that both control and maintenance can be performed more efficiently. At each of plural lamp locations in the network, there is a controller module that receives electric power input and that supplies electric power to the remaining lamp locations. Each controller module has a first relay to deliver current to one or more outdoor illumination lamps at the controller module's location, and a second relay for switching electric power on to a succeeding lamp location. A first current sensor monitors current to the lamps at each lamp location, and a second current sensor monitors current to the remaining locations. The network's power lines form portions of a bi-directional data link via which data is transmitted from each controller module to a command station, and vice versa.

U.S. Pat. No. 6,236,331 to Dussureault is directed to an LED traffic light electronic controller which stabilizes the total output light intensity of the traffic light in order to ensure a constant light intensity of each traffic light color throughout the entire traffic light lifetime. The controller detects the output light intensity of a color, and then automatically adjusts the power input for the LEDs in order to increase the light intensity when needed. The controller works in a closed loop cycle in order to perform real-time control of the light intensity output. Thus, at each moment of the traffic light lifetime, the output light intensity is constant and equivalent to a predetermined standard. This insures traffic safety for the entire traffic light lifetime and also make it last longer. The controller also provides a ballast load when off, and is able to provide an open circuit when the LEDs have exhausted their useful lifespan. The intensity is further controlled by detecting ambient light conditions.

European Patent Application Publication No. EP 1 251 721 to Zaffarami et al. is directed to an urban remote-surveillance system for street lamps, in which a concentrator module sends, using a very low power transceiver, by means of a polling procedure, a message to each of a plurality of remote-control modules equipped with a very low power transceiver and organized in a hierarchical tree structure, defining in the message the destination module and a receiving/transmitting path consisting of a plurality of intermediate modules able to communicate with each other in succession, at the same frequency and without mutual interference, so as to obtain the necessary geographical coverage also using very low power transceivers.

PCT International Publication No. WO 03/043384 to Wacyk et al. is directed to a new architecture for high frequency (HF) ballast with wireless communication interface. The new architecture integrates RF wireless interface into the ballast. A user control transmits an RF control signal to a second antenna at the ballast site which provides the RF signal to the ballast which activates the fluorescent lamp. The ballast includes a transceiver/receiver, a communication decoder, a power control stage and a power stage. The transceiver/receiver receives the RF signal and communicates it to the communication decoder which acts as an interface to the power stage control. The power stage control controls the power stage that activates the fluorescent lamp. The communication decoder, power control stage, power stage and transceiver/receiver are located within the ballast enclosure which is an important part of the invention. If the power stage control is digital it may be combined with the communication decoder into one microprocessor or digital controller such as an ASIC. The communication decoder may be a serial interface. The transceiver/receiver is an RF integrated circuit. The ballast further includes an isolator to isolate the transceiver/receiver from the first antenna. The isolator may be capacitive.

U.S. Publication No. 2003/0222587 to Dowling, Jr. et al. is directed to smart lighting devices bearing processors, and networks comprising smart lighting devices, capable of providing illumination, and detecting stimuli with sensors and/or sending signals. Sensors and emitters can, in some embodiments, be removed and added in a modular fashion. Smart lighting devices and smart lighting networks can be used for communication purposes, building automation, systems monitoring, and a variety of other functions.

The prior art described above teaches an apparatus for addressably controlling remote units, a sign board lighting control system, a radio paging electrical load control system and device, programmable remote control systems for electrical apparatuses, a remote control method for a process, an intelligent outdoor lighting control system, an LED traffic light intensity controller, an urban remote surveillance system for street lamps, an architecture of ballast with integrated RF interface, and universal lighting network methods and systems, but does not teach a wireless electrical apparatus control system that, when the wireless network, the host server or the apparatus' own power are down for a period of time, is yet capable of functioning properly and efficiently and without the need for time data to be sent separately. Aspects of the present invention fulfill these needs and provide further related advantages as described in the following summary.

SUMMARY OF THE INVENTION

Aspects of the present invention teach certain benefits in construction and use which give rise to the exemplary advantages described below.

The present invention is generally directed to a device for controlling one or more electrical apparatuses comprising a processor/transceiver control unit connected to each electrical apparatus and having at least one microprocessor wired to a transceiver and a clock circuit that keeps real-time onboard, the microprocessor storing an operating protocol according to which the control unit controls power to the electrical apparatus at real-time as kept by the clock circuit. In the exemplary embodiment, the clock circuit is synchronized through the receipt of real-time data imbedded in the two-way wireless network's signal. The control unit's microprocessor may be further configured to read and store a nominal voltage for the electrical apparatuses and to compare the nominal voltage to the electrical apparatuses' operating voltage so as to monitor and report on their operation.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

Figure 1:
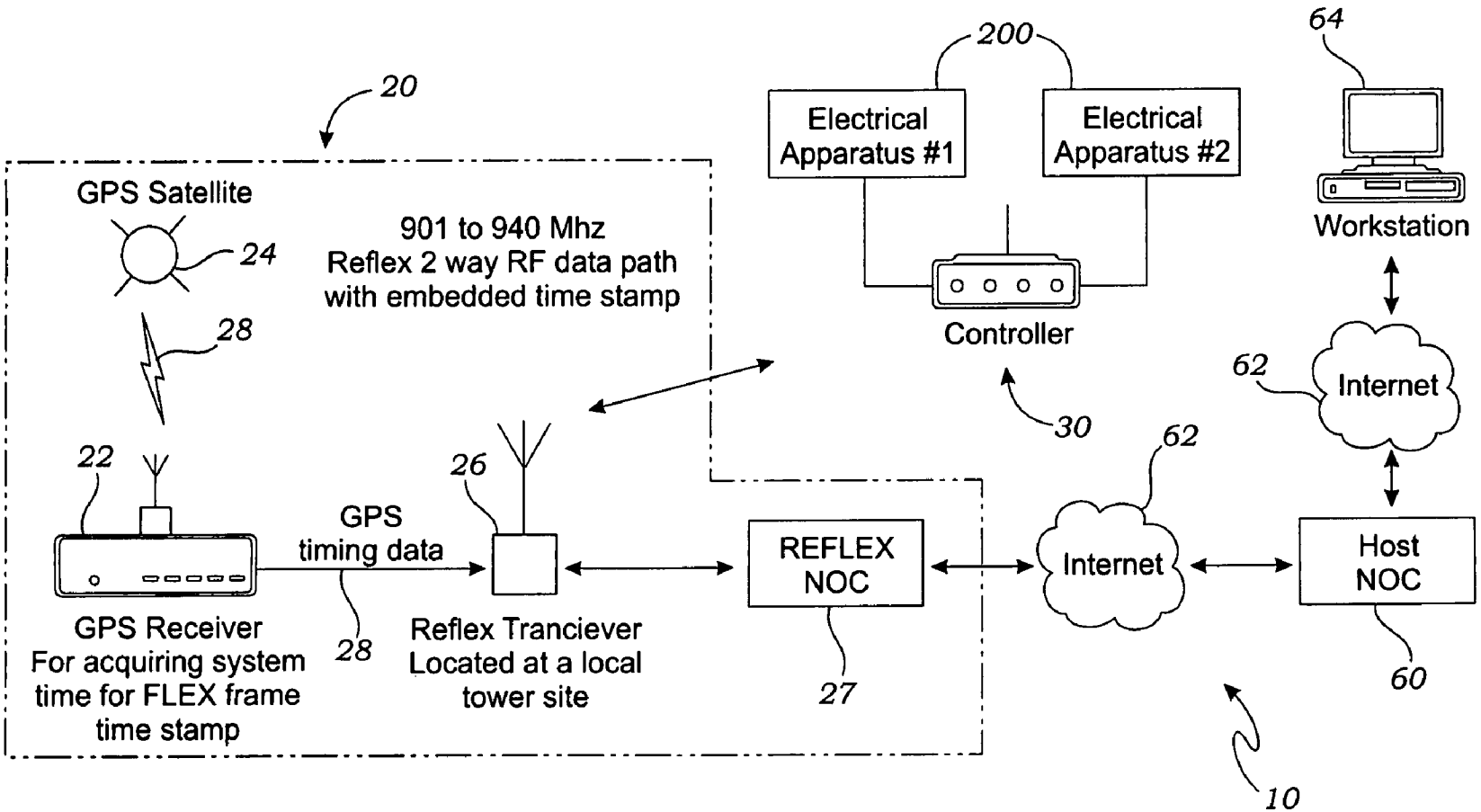
FIG. 1 is a schematic of an exemplary embodiment of the invention.

The above described drawing figures illustrate aspects of the invention in at least one of its exemplary embodiments, which are further defined in detail in the following description.

The present invention is generally directed to a system 10 for controlling one or more electrical apparatuses 200 comprising a wireless network 20 and one or more processor/transceiver control units 30 connected to the electrical apparatuses 200 and communicating with a host network operations center 60 over the wireless network 20. In the exemplary embodiment, the wireless network 20 is a two-way ReFLEX network as is known and used in the art. As such, the wireless network 20 includes a first transceiver 22 configured to acquire and relay real-time data 28 from a global positioning system satellite 24 and a second transceiver 26 configured to receive the real-time data 28 from the first transceiver 22 and to continuously transmit the real-time data 28 to the control unit 30. The processor/transceiver control unit 30 has a third transceiver 32 for receipt of the real-time data 28 and at least one microprocessor 34 wired to the third transceiver 32 for storage of an operating protocol 90 and for processing of the real-time data 28 accordingly. The processor/transceiver control unit 30 further includes a clock circuit 40, such that as the third transceiver 32 receives the real-time data 28 from the second transceiver 26, the microprocessor 34 synchronizes the clock circuit 40 with real-time, whereby the processor/transceiver control unit 30 controls power to the electrical apparatuses 200 according to the operating protocol 90 at real-time as kept by the clock circuit 40. As will be explained in more detail below, each control unit 30 also communicates to and from the host network operations center 60 through the wireless network 20 so as to receive operating protocol 90 commands and send messages confirming receipt and execution of such commands. In this way, a wireless system according to the present invention operates on continuously synchronized real-time according to downloaded operating instructions so as to control, monitor and provide feedback regarding the operation of one or more electrical apparatuses. It will be appreciated by those skilled in the art that this streamlined approach of downloading and synchronizing to real-time data 28 imbedded and inherent in two-way wireless communication has numerous advantages over systems requiring the separate and routine transmission of signals representing system or reference times. It will be further appreciated that while the electrical apparatus 200 is shown and described below in the exemplary embodiment as a light pole, the wireless controller system 10 of the present invention may be employed in remotely controlling virtually any apparatus that is electrically powered, including, but not limited to, lights and lighting standards, pumps, motors, boilers, compressors, heaters, chillers, condensers, appliances, computers and microprocessors, security systems, solenoids, switches, valves, clocks, and timers. With any such apparatus, in the exemplary embodiment, the present invention operates by connecting a processor/transceiver control unit 30 to each electrical apparatus 200 to be controlled. The control unit 30 is essentially wired between the power source 58 for the electrical apparatus 200 and the apparatus itself. The control unit's microprocessor 34 stores an operating protocol 90 for each apparatus 200 and communicates operational information over a wireless network 20 to and from a host network operations center 60, which is securely accessible through the Internet 62. According to the operating protocol 90, the processor/transceiver control unit 30 is then capable of controlling each electrical apparatus 200 to which it is wired. Again, the control unit 30 includes a real-time clock circuit 40 for independent and continuing execution of the operating protocol 90, even were the wireless network 20 or host network operations center 60 to be down. The control unit's microprocessor 34 is configured to synchronize the clock-circuit 40 with the real-time data 28 imbedded in the wireless network 20's radio frequency ("RF") signal when regularly received by the processor/transceiver control unit 30. The present invention then benefits users in several ways. First, it allows for powering electrical apparatuses in an automated, systematic way only as needed, thereby conserving energy through reducing the total amount of time an electrical apparatus is powered. Second, and relatedly, the invention enables users to avoid unnecessary on-time for the electrical apparatuses they are controlling, resulting in savings through both reduced energy consumption and reduced maintenance and replacement costs. Third, this wireless, systematic control of electrical apparatuses can increase the performance and safety of the apparatuses in use. Particularly, because the invention includes an on-board, real-time clock in each processor/transceiver control unit, each such control unit is, again, then capable of continuing its operation as desired even when the wireless network or host server is down. Once more, the wireless network shown and described in the exemplary embodiment is a two-way narrowband wireless data network such as that based on the industry-recognized Motorola® ReFLEX™ protocol. Accordingly, the processor/transceiver control unit 30 employs a binary data protocol based on an octet (8 bits representing 1 byte) to communicate with the network 20, whereby data values can be represented as one or multiple bytes depending on the value's range. However, it will be appreciated that virtually any two-way wireless data transmission system and corresponding data protocol now known or later developed in the art can be employed without departing from the spirit and scope of the present invention.

Figure 2:
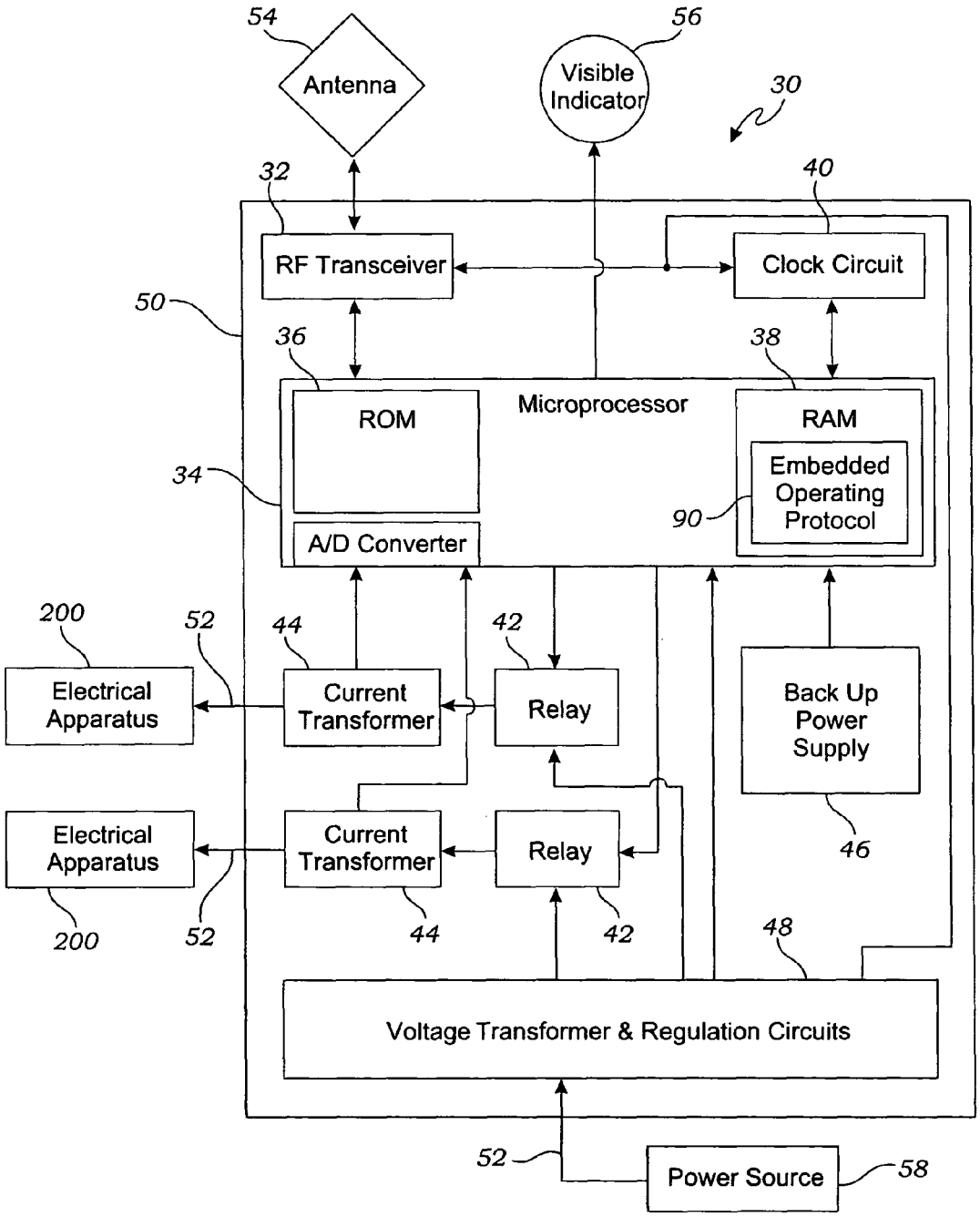
FIG. 2 is a schematic of an exemplary control unit thereof.

Turning to FIG. 2, the processor/transceiver control unit 30 is shown schematically as generally including a microprocessor 34, a transceiver 32, and a clock circuit 40. While the clock circuit 40 is shown as being separate from the microprocessor 34, it will be appreciated that it may also be imbedded within the microprocessor 34. The microprocessor 34 may be virtually any such device now known or later developed in the art capable of storing and executing operating programs and data and interfacing with other electrical devices wired thereto. As such, the microprocessor 34 is preferably configured with a permanent "read only memory" ("ROM") device 36 and a temporary random access memory ("RAM") device 38, though as with the clock circuit 40, it is possible that these memory devices 36, 38 could be separate devices from the microprocessor 34 within the control unit 30's circuitry. The permanent memory device 36 generally stores all of the internal programming of the microprocessor 34 that govern its operation, while the temporary memory 38 stores such data as the operating protocol 90, as explained in more detail below. The control unit 30 further includes one or more channels, or relays 42, each having a current transformer 44. The operation of the relays 42 and current transformers 44 in providing and monitoring electrical power, or voltage, to the connected electrical apparatuses 200 under the control of the microprocessor 34 is also described in detail below. The power typically required to operate the processor/transceiver control unit 30 of the present invention is approximately 20 volts in the exemplary embodiment. It is desirable that each control unit 30 be powered by the same circuit, or power source 58, that is providing power to the electrical apparatuses 200 themselves so that a separate power supply for each control unit 30 is not necessary, except in the limited case of a back-up power supply 46, described below. However, most electrical apparatuses 200 to be controlled by the control unit 30 operate on at least the typical 120 volts, while larger apparatuses and systems, such as commercial outdoor lighting systems, can operate on up to 480 volts. As such, the control unit 30 may also be equipped with a voltage transformer 48 as necessary to convert the line voltage of the electrical apparatuses 200 as provided by the power source 58 to the 20 volts needed to power the control unit 30. At a minimum, control units according to the present invention may be configured with the necessary transformer to step down voltages of 480, 347, 277, 240, 208 or 120 volts, though other such transformers are possible without departing from the spirit and scope of the present invention. In the event of a loss of electrical power to the control unit 30, the unit's back-up power supply 46 is to at least have enough stored power to back-up the runtime and threshold nominal voltage data and shut down properly. In an exemplary embodiment this may be accomplished through a high capacitance capacitor that can provide full power to the unit 30, and particularly the microprocessor 34, for up to approximately ten seconds after a complete power outage, providing ample time for the microprocessor 34 to "flash" the temporary memory device 38 with runtime data and other such information and then shut down. The back-up power supply 46 may further be capable of continuing to power the control unit 30, and particularly the clock circuit 40, for a finite time, such as one week, so as to maintain current date and time and enable the unit 30 to control the electrical apparatus 200 according to its stored operating protocol 90 as a default. This may be achieved through an on-board battery or other such device. Such a back-up power supply 46 may not be able to provide sufficient power to send and receive messages, though. However, it will be appreciated that the back-up power supply 46 may take on numerous other forms, both now known and later developed in the art. When electrical power is restored, the control unit 30 will again synchronize its on-board time as kept by the clock circuit 40 with real-time as provided by the wireless network 20 (FIG. 1) and will send a "power on" acknowledgement message to the host network operations center 60 (FIG. 1). The back-up power supply 46 will also be recharged by the now restored AC line voltage. The programming of the control unit 30, again, is stored in a permanent memory device 36 within the microprocessor 34 and the temporary memory device 38 to which the other transient information is "flashed" is preferably non-volatile so that neither are affected by power outages, whether or not a back-up power supply 46 is in place. A UL and NEMA 4X rated electrical enclosure 50 is configured to house the processor/transceiver control unit 30 circuitry. In the exemplary embodiment, the enclosure 50 is a roughly 3"×3"×9" water-tight plastic body and is, in any configuration, preferably configured so as to be conveniently installed on virtually any surface in the vicinity of the electrical apparatuses 200 to be controlled or to the exterior or within the interior of a specific electrical apparatus 200 with which the control unit 30 is associated. Accordingly, the wires 52 through which the control unit 30 is to be connected to the line voltage supplying the electrical apparatuses 200 and to the apparatuses themselves may exit from an end of the enclosure 50 and/or the back and may in either case be approximately 3' in length, though it is to be appreciated that these locations and lengths are merely exemplary. The transceiver 32's antenna 54 may be directly installed within or to the control unit 30's enclosure 50, or the antenna 54 may be separately installed and be connected to the control unit 30 through an antenna cable, which would typically be on the order of 20' in length, though virtually any length is possible. A visible indicator 56, in the exemplary embodiment comprising one or more LEDs, may be configured on the outside of the control unit 30's enclosure 50 so as to indicate on location such status conditions of the control unit 30 as when power is supplied to the unit 30, when the transceiver 32 is active (perhaps even separately as a "transmitter active" LED and a "receiver active" LED), and when any of the relays 42 are active, are experiencing an over- or saturated-voltage condition, or have been overridden. This visible indicator 56 can take numerous forms, both now known and later developed in the art, and may also provide information beyond the exemplary power and network connection status. In addition to the above-described circuit elements and features, the control unit 30 may also be configured with a manual power switch (not shown), a voltage calibration adjustment (not shown) on each relay 42, and a data interface port (not shown), such as an RS-232 port. It will be appreciated by those skilled in the art that numerous other physical and electrical configurations of the processor/transceiver control unit 30 of the present invention may be employed without departing from its spirit and scope.

Figure 3A:
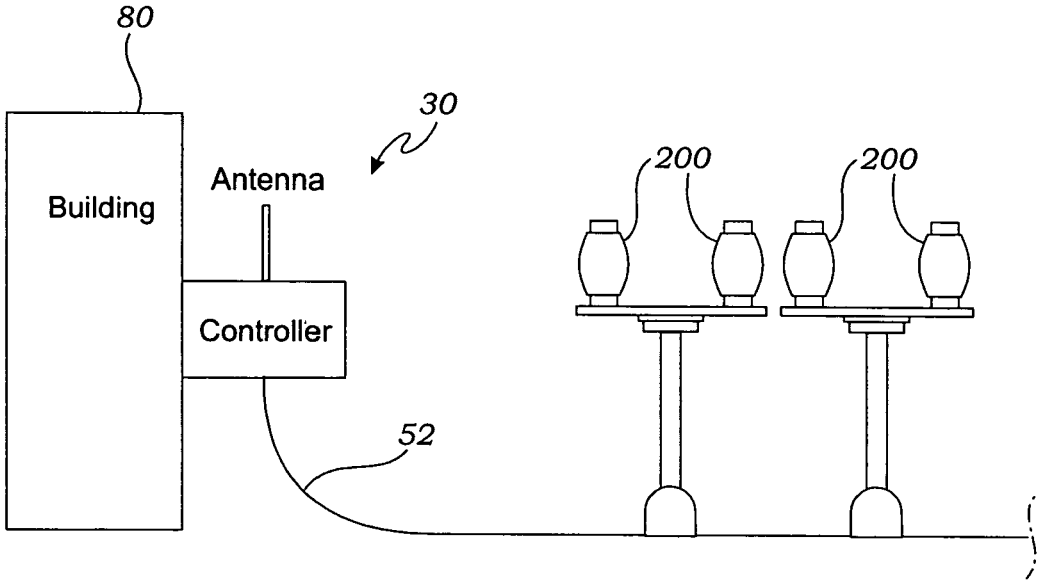
FIGS. 3*a* and 3*b* are schematics of alternative exemplary embodiments thereof.
Figure 3B:
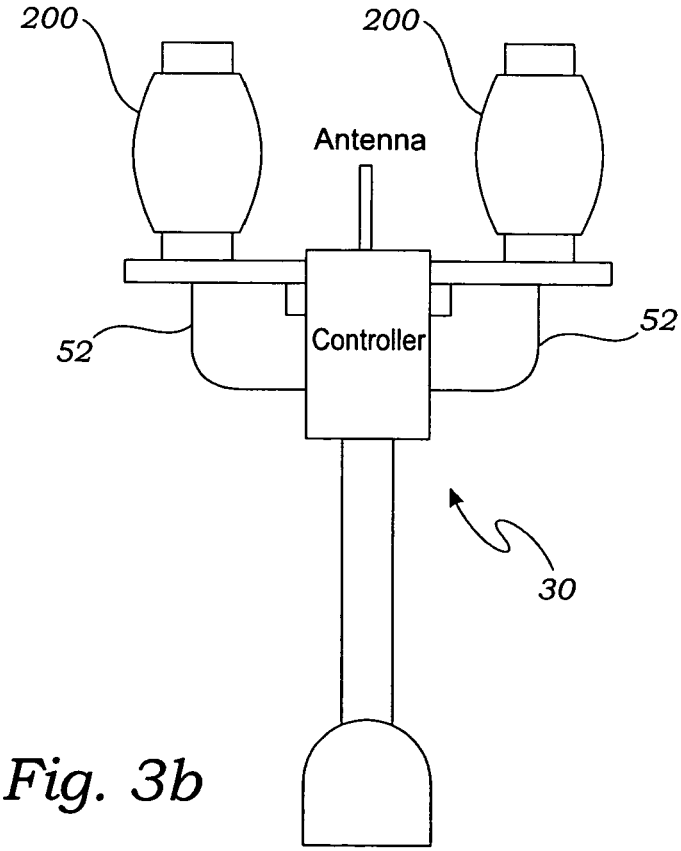

Referring now to FIGS. 3*a* and 3*b*, the processor/transceiver control unit 30 is shown as being connected to one or more electrical apparatuses 200. Specifically, as illustrated in the exemplary embodiments, a single control unit 30 may be connected to a single electrical apparatus 200 or multiple apparatuses 200. When multiple apparatuses 200 are to be controlled, the apparatuses 200 may be connected in series so as to all be controlled in the same way according to a single operating protocol 90. Accordingly, in the exemplary embodiment of FIG. 3*a* involving multiple light pole electrical apparatuses 200, the processor/transceiver control unit 30 may be installed at some on-site location, such as on a building 80, so as to be in series between a group of lights 200 and their power source 58 (FIG. 2). In this way, as explained in more detail below, a single operating protocol 90 stored within the processor/transceiver control unit 30 can be used to control multiple light pole electrical apparatuses 200. Or, multiple apparatuses 200 may be independently controlled by a single processor/transceiver control unit 30 by each being connected to separate channels, or relays 42, of the control unit 30, as shown in the alternative embodiment of FIG. 3*b*. In the alternative exemplary embodiment, then, the control unit 30 is configured with two channels 42, each being wired to a separate bulb or ballast defining the respective light pole electrical apparatus 200 and each being assigned a different operating protocol 90 stored in the control unit 30's memory 38 (FIG. 2). In this way, one bulb or ballast can operate according to one protocol and one according to another. It will be appreciated by those skilled in the art that a single processor/transceiver control unit 30 can be configured with virtually any number of channels 42, and so control a number of different electrical apparatuses 200 separately, and that the two channels shown and described are merely exemplary.

Figure 4:
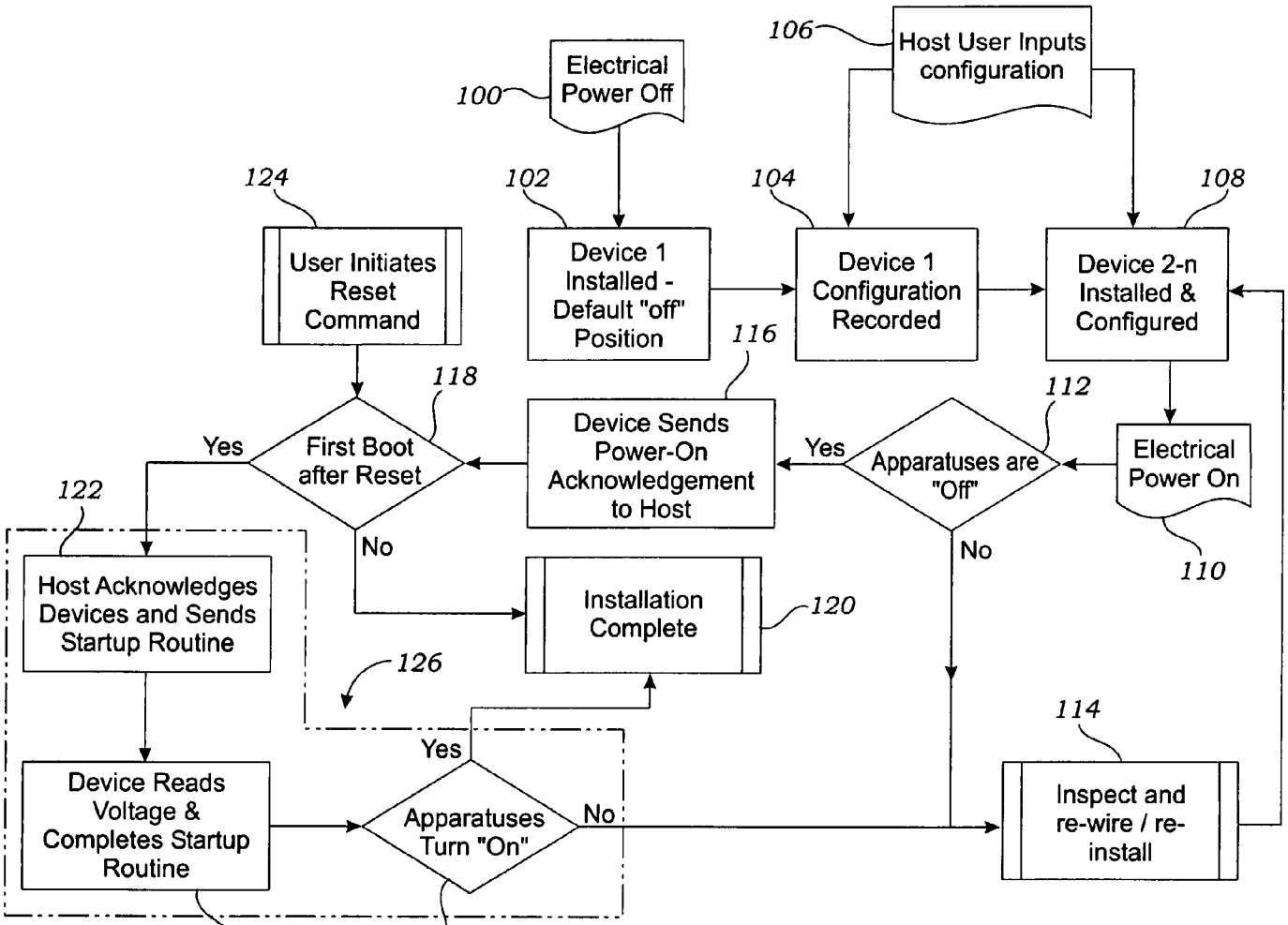
FIG. 4 is a flow chart depicting the installation and initialization of an exemplary embodiment thereof.

The processor/transceiver control unit 30 is installed and connected to one or more electrical apparatuses 200 and then powered up and initialized as shown in FIG. 4. At step 100 the power source 58 (FIG. 2) feeding the electrical apparatus(es) 200 to be controlled is initially switched off. In step 102, a first control unit 30 is then wired between the power source 58 and the electrical apparatuses 200, as described above (see FIGS. 2, 3*a* and 3*b*). When first installed, the control unit 30 is in a default "off" position. At step 104, the configuration of the control unit 30 is recorded, which includes, as indicated at step 106, user input through the host network operations center 60 (FIG. 1) of such information for each control unit 30 as its identification, geographical location, relay settings, and number of electrical apparatuses connected, more about which will be said below. This same process of installing and configuring a control unit 30 can then be repeated for numerous such units, as indicated at step 108. In step 110, the power source 58 feeding the electrical apparatus(es) 200 now connected to one or more control units 30 is switched on. Because the control units 30 are installed in a default "off" condition, if the installation has been successful and the units 30 are operating to control their respective electrical apparatuses 200, the apparatuses 200 should remain "off" even though their power source 58 is now "on," as indicated at step 112. If the electrical apparatuses 200 are "on" rather than "off," the installation of the control unit(s) 30 should be inspected and corrected as necessary, as indicated at step 114. If the electrical apparatuses 200 do remain "off" so as to indicate that the control units 30 have been installed and are operating correctly, in step 116 each control unit 30 would then automatically send a power-on acknowledgement message to the network operations center 60 over the wireless network 20 (FIG. 1). At step 118, if this "power-on" condition is not the first "boot up" after an installation or reset, then the power-up is essentially complete, as indicated at step 120. However, if the "power-on" condition is the first "boot up," as it would always be after an installation, the network operations center 60 replies to the power-on acknowledgement message sent at step 116 with a startup routine or "Operate Initialization Routine" command, as indicated at step 122. It will be appreciated that a first "boot up" and, hence, the startup routine can also be initiated by a user reset command, as in step 124. Beyond a command to the control units 30 to begin the initialization routine 126, the user may also at step 124 selectively set the parameters for the initialization routine. That is, the control unit 30 runs an initialization routine 126 that is configured by the user through the host network operations center 60 (FIG. 1) and executed upon transmission of the initialization or "boot-up" command from the host. Generally, the initialization routine 126 includes at least one on/off cycle, as in step 130, and a voltage reading to determine the nominal voltage, as in step 128, explained below. A second on/off cycle can follow the voltage reading 128, if so configured by the user. Variables for the initialization routine 126 that can also be elected by the user include the duration of the on/off cycles and the time between cycles. In the case of the exemplary embodiment in which light poles are controlled, it is preferable that the duration of the on/off cycle be sufficient to allow the light bulbs to be fully energized before the threshold nominal voltage is measured, as described below. At the completion of the required number of on/off cycles and the voltage reading, if the electrical apparatuses 200 are properly powered and functioning, as indicated by the nominal voltage reading, the control unit 30 will send an initialization confirmation message and the installation will be complete, as in step 120. Again, if one or more of the electrical apparatuses 200 are not properly powered or functioning or the initialization routine 126 is otherwise not successfully completed, an initialization status message so indicating and, when needed, a low-, saturation-, or off-voltage alarm message will be sent from the control unit 30 to the network operations center 60 to trigger the appropriate corrective action, such as inspection and reinstallation as in step 114. Regarding the voltage reading at step 128, as set forth above, each control channel or relay 42 of the processor/transceiver control unit 30 has a current transformer ("CT") 44 (FIG. 2) for monitoring circuit amperage. During the initialization routine 126, then, the control unit 30 will calculate a threshold nominal voltage value based on the electrical apparatus(es) 200 assigned and connected to each relay 42. The number of apparatuses 200 per control unit 30 and/or relay 42 is, again, set by the user at step 106. Actual operating CT voltage is monitored only when that channel's relay 42 is "on" and only after the initialization routine 126 is completed. All such voltage monitoring is internal to the control unit 30, except when a low-voltage condition is detected and reported or when an on-demand status request is initiated by a user through the host network operations center 60. Regarding a detected low-voltage condition, which would indicate that one or more of the electrical apparatuses 200, such as a bulb, has failed or is otherwise not functioning properly, the alert voltage change ($\Delta V_a$) is determined by dividing the nominal voltage ($V_n$) determined during installation by the number of electrical apparatuses (n), assuming each apparatus draws the same power.

$$\Delta V_a=(V_n/n)$$

For example, if the electrical apparatus 200 being controlled is a light pole having four bulbs per ballast or relay and a threshold nominal voltage of 2.0 volts, the alert voltage change would be 0.5 volts. Accordingly, when an operating CT voltage of 1.5 volts is detected on the control channel by the current transformer, a low-voltage alert would be warranted, specifically indicating that one of the four bulbs is out or malfunctioning. Continuing the example, it would follow that if an actual CT voltage of 1.0 volt were detected, that would indicate that two of the four bulbs were out or malfunctioning, and so on. Again, it will be appreciated by those skilled in the art that a similar approach using voltage changes may be employed in monitoring and reporting on the operation of a variety of electrical apparatuses being controlled and, as such, that the monitoring and reporting of bulb outages is merely exemplary. Once a low-voltage condition is detected, a voltage alert signal is sent to the network operation center 60 for corrective action, as described more fully below. Regarding user input of information relating to the geographical location of a particular control unit 30, as in step 106, inherently, the geographical location of each unit 30 falls within a specific time zone. With this location and time zone pin-pointed, the control unit 30 can be configured to make the appropriate offset from the international Greenwich Mean Time ("GMT") real-time data 28 provided from the wireless network 20 (FIG. 1) so as to synchronize to local real-time. In the continental United States, for example, there are effectively five time zones: (1) eastern daylight savings time ("EDST"), four hours earlier than GMT; (2) eastern standard time ("EST") or central daylight savings time ("CDST"), five hours earlier than GMT; (3) central standard time ("CST") or mountain daylight savings time ("MDST"), six hours earlier than GMT; (4) mountain standard time ("MST") or pacific daylight savings time ("PDST"), seven hours earlier than GMT; and (5) pacific standard time ("PST"), eight hours earlier than GMT. Thus, with the control unit 30 powered up and initialized and ready for communication, the unit's time zone can be set through a host- or user-initiated command. Specifically, in the exemplary embodiment, a global positioning system ("GPS") satellite 24 transmits international standard time data 28 in Greenwich Mean Time ("GMT"), which is then acquired by a GPS transceiver 22 and transmitted to a ReFLEX transceiver 26 located at a local tower site. The ReFLEX transceiver 26 then encodes the real-time data 28 for ReFLEX-frame time-stamp transmission, which under the current protocol would be a 901 to 940 MHz ReFLEX two-way radio frequency signal with the embedded time stamp, such as in the first frame of a 16- or 32-frame data header. Ultimately, this GMT real-time data 28 is received by the remote processor/transceiver control unit 30 located at the electrical apparatus 200. Because the control unit 30 has been set-up and initialized, including accounting for its geographical location, and thus time zone, the unit is able to convert the GMT real-time data 28 imbedded in the ReFLEX transmission into local time, or system time, for that particular control unit 30. The date may also be embedded in the real-time data 28 signal and/or may be initially set by the user during unit installation at step 106. Again, while a two-way ReFLEX network 20 is shown and described in the exemplary embodiment, it will be appreciated that any two-way wireless data transmission system now known or later developed in the art that includes imbedded real-time data inherent in the network provider's signal can be employed without departing from the spirit and scope of the present invention. Beyond configuring each unit 30's time zone remotely through a command sent from the host network operations center 60 according to the geographical location of the control unit 30 determined during installation, as explained more fully above, in the exemplary embodiment, the control unit 30 is further capable of accounting for sunrise and sunset in its particular location for more accurate and efficient control of its associated electrical apparatuses 200, particularly lights and lighting systems. Essentially, to determine the sunrise and sunset (dawn and dusk) times, the latitude and longitude of each control unit 30 is also defined. In the exemplary embodiment, these values are sent from the host 60 to each control unit 30 during setup and initialization. With the date and these values, the control unit 30 itself, through its microprocessor 34 and permanently stored programming, is able to calculate sunrise and sunset times and to control its associated electrical apparatus(es) 200 accordingly, depending on whether a dusk/dawn with cutback or dusk/dawn with start time or end time schedule is stored in the control unit 30, as explained below. It will be appreciated by those skilled in the art that the latitude and longitude data and the corresponding sunrise and sunset calculations may be downloaded or made in a number of other ways without departing from the spirit and scope of the invention.

Figure 5:
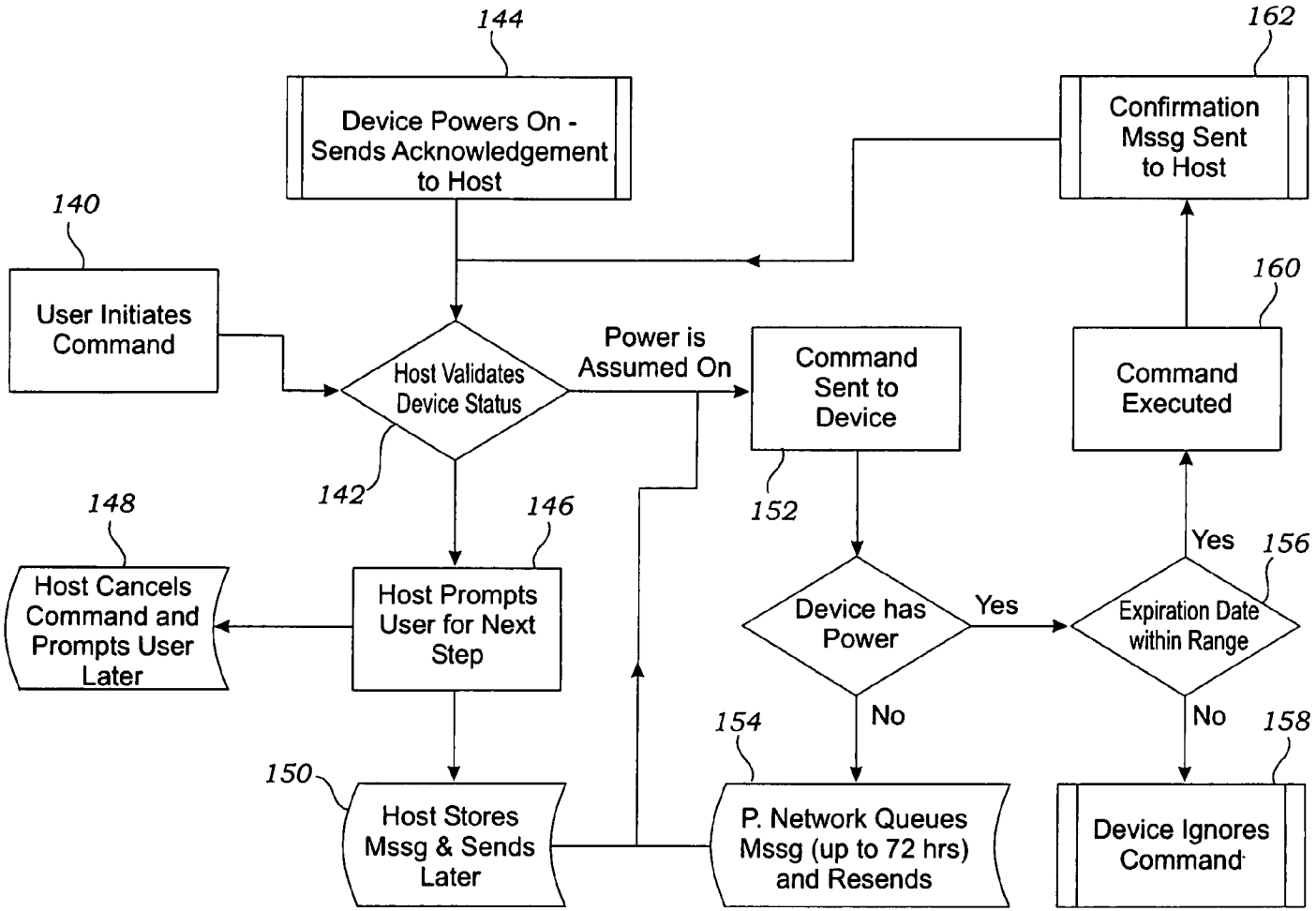
FIG. 5 is a flow chart depicting communications in an exemplary embodiment thereof.

Turning now to FIG. 5, an operating protocol 90 (FIG. 2) is stored in the microprocessor 34, or other memory location 38 of each processor/transceiver control unit 30 for each channel 42, either at the factory or through a wireless signal generated by the user interfacing with the system 10 over a secure Internet connection 62 to the host network operations center 60. The user may also indirectly initiate the storage of the operation protocol 90 by initially configuring the control unit 30 and/or the network operations center 60 such that operating instructions are sent to one or more control units 30 automatically. The host 60 is essentially a web-based server and corresponding software configured to process and cooperate with user commands in configuring the control units 30. As explained in more detail below, each operating protocol 90 is essentially either a permanent, or default, schedule or a temporary, or override, schedule. Generally, messages of any kind are communicated to the control unit 30 over the wireless network 20 at the initiation of a user through a terminal 64 (FIG. 1), as indicated in step 140, though, again, some messages may be sent automatically. At step 142, the host network operations center 60 (FIG. 1) then validates the unit 30's status before proceeding further, which would include insuring that the particular unit 30 to which the user's command is directed is powered up through the request for and receipt of a power on or "Boot Up" message from the unit 30, as in step 144. If power is not found to be on for the control unit 30 at issue or it is otherwise unresponsive or not functioning properly, the host 60 will prompt the user for a next command, as indicated at step 146, which would essentially be to cancel the command and prompt the user later when the unit 30 is responding and/or powered up, as in step 148, or store the command at the network operations center 60 and send it later when the unit 30 is responding and ready, as in step 150. In step 152, once the control unit 30 is found to be on and ready to receive transmissions, either initially or on a retry, or if such is assumed by the host 60, the command is at that time sent over the wireless network 20 to the control unit 30. If the control unit 30 does not have power or the command is otherwise not received by the unit 30, the command is stored and queued for retransmission, as indicated at step 154. When any such command message is sent from the host 60, in the exemplary embodiment, it will include a date/time stamp in the time zone of the control device 30 to which the message is being sent, which is effectively the expiration date/time for the message. Thus, where the control unit 30 in fact has power and successfully receives the command signal, in step 156, the expiration date/time of the signal is compared by the control unit 30 to real-time for that location as kept by its clock circuit 40. If the command is received after the expiration date/time stamp it is to be ignored by the control unit, as in step 158. On the other hand, if the command is received before the expiration date/time or there is no date/time stamp in the command message from the host 60, in which case the control unit 30 is to assume that the command has no expiration, the command is executed accordingly, as in step 160. At step 162, after any command is executed, a confirmation message is sent from the control unit 30 to the host network operations center 60, as explained in more detail below. Those skilled in the art will appreciate that the command message communication shown and described is merely exemplary and that numerous other command and message sequences can be employed without departing from the spirit and scope of the present invention.

In controlling the electrical apparatuses 200 to which a particular processor/transceiver control unit 30 is connected, in the exemplary embodiment each unit 30 generally follows its stored operating protocol 90 (FIG. 2) according to a hierarchical approach. The default operating protocol 90 is any associated permanent schedule. Permanently scheduled events, or events which are recurring, are generally defined by their day of execution, start time, event number, relay state, and duration. In the exemplary embodiment, three events per day may be configured for each day of the week, or a total of twenty-one scheduled events per week. In other words, Monday can have a different permanent schedule than Tuesday, etc. Accordingly, portions of the permanent schedule may be updated or changed remotely without transmitting an entire schedule batch. As above, if electrical power to the control unit 30 is lost, the unit 30 will maintain its permanent schedule and run accordingly until power is restored and a different schedule is imposed, either as a temporary schedule or through an on-demand command. If a temporary schedule is then transmitted by the user through the host network operations center 60 to the control unit 30, the temporary schedule will be followed and will override the permanent schedule to the extent that the times in the respective schedules overlap. Temporary scheduled events are single or one-time events that are generally defined by a day of execution, start time, relay state, and duration. In the exemplary embodiment, twenty-one temporary scheduled events may be stored in the memory of the control unit, though it will be appreciated that any number of temporary events can be scheduled, as they are not limited by a weekly or daily interval, but may be scheduled at any time. Regarding the duration of a temporary scheduled event, if the duration is set to zero, the temporary event will run indefinitely until the inverse relay state is executed by a permanent schedule or an on-demand command sent by a user. Any other duration will cause the temporary event to run for that time period from the start time, at the end of which the control unit will return to its default state according to the permanent schedule. Thirdly, whether the control unit 30 is presently controlling its associated electrical apparatus(es) 200 according to a permanent or temporary schedule, if an on-demand command is transmitted from the host 60 having a start time that is the same as or later than real-time, the on-demand command will be executed at the appropriate time, thereby overriding any permanent or temporary schedule on which the control unit would otherwise be operating. Examples of on-demand commands that may be sent from the host network operations center 60 to a remote processor/transceiver control unit 30, again, either at the initiation of a user or automatically, include "On," "Off," "Record Voltage," and "Reset." Once the on-demand command is completed, the control unit 30 will revert back to whatever schedule, permanent or temporary, it was to be following at that time. Moreover, rather than actual times of day, the processor/transceiver control unit 30 can execute according to an operating protocol 90 that accounts for sunset and/or sunrise, or dusk/dawn, the calculations of which are explained above. Where the electrical apparatus 200 is a light pole that is to be turned on a certain number of minutes before dusk and/or turned off a certain number of minutes after dawn, for example, an operating protocol based on dusk/dawn with cut-back can be employed. As such, the dusk/dawn times corresponding to when the electrical apparatus 200 would be turned on and off may be adjusted by a fixed number of minutes, such as thirty minutes before dusk and thirty minutes after dawn. Similarly, where electrical apparatus 200 is to be turned on at dusk or turned off at dawn but have a fixed end time or start time, respectively, an operating protocol based on dusk with end time or dawn with start time can be employed, for example. In this way, dusk or dawn can be one triggering event, but a fixed time can be the other. It will be appreciated that both the dusk/dawn with cut-back and dusk/dawn with start or end time operating protocols may be useful in connection with numerous electrical apparatuses beyond light poles and that, as such, the light poles shown and described are, again, merely exemplary. In the exemplary embodiment, the commands that may be sent to the processor/transceiver control unit 30, either automatically or as initiated by the user, include, but are not limited to, "Set Time Zone," "Operate Initialization Routine," "Set Warm Up Duration," "Set Alarm Voltages and Bias," "Set Default Device State," "Set Permanent Scheduled Events," "On Demand," "Channel Override," "Configure Dawn/Dusk Operation," "Configure Dawn/Dusk Operation with Start Time," "Configure Dawn/Dusk Operation with End Time," "Set Temporary Scheduled Event," "Delete Temporary Scheduled Event," "Clear Event Configuration," "Enable/Disable Voltage Alarm Monitor Message," "Acknowledge Alarm Message," "Clear Alarm Message," "Set Runtime Download Message," "Set Boot Message," "Reset to Default," "Status Request," "Voltage Reading Request," "Runtime Log Request," "Check-sum Request," "Event Configuration Request," "Alarm Voltage Request," "Event State Request," "Time Stamp Request," and "Initialization Request."

As indicated previously, communications from the remote processor/transceiver control unit 30 are transmitted through a local ReFLEX transceiver 26 and a ReFLEX network operations center 27 and then to the host network operations center 60 via the Internet 62 (FIG. 1). Users may also receive messages from and remotely program one or more of the remote processor/transceiver control units 30 through the same host network operations center 60 over the Internet 62, with signals corresponding to communications from a user to a particular processor/transceiver control unit 30 also being transmitted through the two-way ReFLEX network 20. Again, while a two-way ReFLEX network is shown and described in the exemplary embodiment, it will be appreciated that any two-way wireless data transmission system now known or later developed can be employed without departing from the spirit and scope of the present invention. Further, in the exemplary embodiment, the user views the control units 30' configurations and activities and sends and receives communications regarding such through a terminal interface 64 operating over a global communication network 62. An example of such is viewable through a VT-102-compatible terminal emulator program, though, again, it will be appreciated that numerous software programs and configurations, both now known and later developed, for facilitating network data transmission may be employed in the present invention. Regarding the host 60's, and ultimately the user's, tracking the status and performance of the electrical apparatuses 200 being controlled by the wireless system 10 of the present invention, there are numerous status messages that may be sent by the control units 30, again, either automatically or at the user's specific initiation. First, as above, each processor/transceiver control unit 30 effectively sends a confirmation message whenever a command is received and its function performed, the initialization routine 126 described above not excepted, which automatically sends an initialization confirmation as part of its very function. Confirmations are generally sent only when commands or messages are communicated from the host network operations center 60 to the control unit 30, with the intent to confirm that the message was received and executed. Accordingly, each confirmation message preferably includes a command identifier. Whenever the processor/transceiver control unit 30 powers an associated electrical apparatus 200 or otherwise boots, a "power-on" or "boot up" message will be transmitted from the control unit 30 to the host network operations 60 center via the wireless network 20. This feature, which is part of the software code permanently stored in the control unit 30's microprocessor 34, may nonetheless be enabled or disabled remotely over the wireless network 20. The control unit 30 may also provide a status message on polling by the host 60, which would include the relay state (on or off), the actual voltage(s) measured by the current transformer(s), the current relay runtime, and the date and time the status was requested. Relatedly, the control unit 30 stores daily runtime data that can be downloaded in batch form to the host 60 based on a user- or host-initiated command. Further, the control unit 30 may be configured to send runtime data to the host 60 once per day automatically. In one configuration, the control unit 30's daily runtime data, or heartbeat message, is set to include the total relay on-time for the 12-hour morning period and the 12-hour evening period of the 24-hour daily run cycle. Check-sum is a programming feature of the processor/transceiver control unit 30 that periodically verifies its scheduling information against that of the host 60, or the unit 30's event configuration against that entered by the user. The control unit 30 can be queried automatically by the host 60 or by a user command. In the exemplary embodiment, the check-sum used is a cyclic redundant code employing polynomial of width 8 ("CRC-8"). It will be appreciated by those skilled in the art that a variety of programming codes or steps may be employed in periodically verifying the control unit 30's scheduling data against that entered by the user and that the CRC-8 check-sum is merely exemplary. A reset command may be sent to the processor/transceiver control unit 30 so as to erase all configuration information and return the control unit 30 to its factory defaults. The reset feature is useful when the control unit 30 is reinstalled in another environment and must be reset so that the host network operations center 60 can initiate the initialization routine 126 described above. As above, the control unit 30 is also configured to send a voltage alert signal when a low-voltage, saturation-voltage, or off-voltage condition is detected, which indicates that one or more electrical apparatuses being controlled has in some way malfunctioned, as explained above. The alert signal will generally include the type of alert and the date and time of the alert. Alerts are sent to the host network operations center 60 initially in real-time as they occur, and then every twenty-four hours until the control unit 30 receives a message from the host 60 confirming receipt of the alert. Even after receiving the confirmation message from the host 60, the control unit 30 stays in alert mode, without sending additional alerts, until an acknowledgement that the situation has been corrected is received, typically in the form of clear alert command initiated by the user over the Internet 62 through the host network operations center 60. While the above-described alert signal protocol is the exemplary default for the control units 30, each alert function can be wirelessly enabled or disabled for each control channel, or relay 42, through user commands. In addition to the voltage alert signals, the control unit 30 may be further programmed to similarly send other alert signals, such as a relay failure alert indicating that a control channel, or relay 42, itself has malfunctioned. Moreover, it will be appreciated by those skilled in the art that numerous other combinations and sequences of wireless alerts and response communications are possible without departing from the spirit and scope of the invention. In the exemplary embodiment, the messages that may be sent from the processor/transceiver control unit, either automatically or as initiated by the user, include, but are not limited to, "Boot Up," "Initialization Complete," "Low Voltage Alarm," "Saturation Voltage Alarm," "Off Voltage Alarm," "Channel Voltage Reading," "Device Status Reading," "Daily Runtime Download," "Runtime Log," "Check-sum Response," "Event Configuration Response," "Stored Alarm Voltages," "Event State Download," "Time Stamp Download," "Initialization Status Download," and "Command Confirmation."

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventors believe that the claimed subject matter is the invention.

What is claimed is:

1. A system for controlling one or more electrical apparatuses substantially at real-time, the system consisting essentially of:

a time-based wireless two-way network having imbedded real-time data inherent in a signal broadcast from the network at frequent regular intervals;

a host network operations center for communicating operating protocol commands over the wireless two-way network while expressly not communicating any real-time data; and a processor/transceiver control unit connected to the one or more electrical apparatuses to be controlled and having at least one microprocessor wired to an RF transceiver through which the host network operations center communicates with the processor/transceiver control unit over the wireless two-way network, the microprocessor storing the operating protocol commands as sent from the network operations center and storing software code, the processor/transceiver control unit further including a clock circuit, the RF transceiver and microprocessor being configured in cooperation with the software code to receive, extract, and keep in the clock circuit the real-time data embedded in the network signal, whereby the processor/transceiver control unit controls power to the one or more electrical apparatuses according to the operating protocol commands sent from the network operations center at real-time as kept by the clock circuit with such real-time data being acquired by the processor/transceiver control unit through the wireless two-way network by which the operating protocol commands are sent, thus eliminating the need for a separate GPS receiver in the system for receiving real-time data.

2. A method of controlling one or more electrical apparatuses wirelessly over a time-based two-way wireless network having real-time data imbedded in a signal broadcast from the wireless network at frequent regular intervals, comprising the steps of:

wiring a control unit between a power source and each electrical apparatus;

programming the control unit with an operating protocol and software code configured to acquire and utilize digital binary real-time data from the network signal;

communicating with the control unit from a host network operations center through the wireless network;

receiving and extracting at the control unit the real-time data automatically imbedded in a signal broadcast from the wireless network;

keeping the real-time data in a clock circuit of the control unit as enabled by the software code residing on a microprocessor of the control unit; and controlling each electrical apparatus according to the operating protocol in conjunction with the real-time data in the clock circuit.

3. The method of claim 2 comprising the further steps of:

executing as the operating protocol an on demand command sent from a network operations center over the wireless network;

executing as the operating protocol a temporary schedule stored in the microprocessor of the control unit for the days and times not overridden by an on demand command; and executing as the operating protocol a permanent schedule stored in the microprocessor for the days and times not overridden by an on demand command and a temporary schedule.

4. The method of claim 2 comprising the further steps of:

connecting a first electrical apparatus to a first relay wired to the microprocessor of the control unit;

connecting a second electrical apparatus to a second relay wired to the microprocessor;

controlling the first electrical apparatus according to a first operating protocol stored in the control unit; and controlling the second electrical apparatus according to a second operating protocol stored in the control unit.

5. The method of claim 2 comprising the further steps of:

initializing the control unit through at least one on/off cycle followed by a voltage reading to determine a nominal voltage of the control unit;

setting a time zone of the control unit remotely; and adjusting the real-time data at the control unit according to the time zone.

6. The method of claim 5 comprising the further steps of:

running the control unit through two on/off cycles;

setting the duration of each on/off cycle remotely; and setting the time between cycles remotely.

7. The method of claim 2 comprising the further steps of:

setting the number of electrical apparatuses wired to the control unit;

determining a nominal voltage of the control unit based on the number of electrical apparatuses;

reading an actual operating voltage when the control unit and its associated electrical apparatuses are powered; and comparing the operating voltage to the nominal voltage to assess the performance of the electrical apparatuses.

8. The method of claim 7 comprising the further steps of:

calculating an alert voltage change by dividing the nominal voltage by the number of electrical apparatuses; and sending a low-voltage alert message from the control unit over the wireless network to the network operations center if the operating voltage has dropped from the nominal voltage by an amount greater than or equal to the alert voltage change.

9. The method of claim 2 comprising the further steps of:

setting a time zone of the control unit;

setting a latitude and longitude coordinate of the control unit; and calculating the sunrise and sunset time for the control unit.

10. The method of claim 2 comprising the further steps of:

stepping down the voltage of the power source using a voltage regulator connected in circuit between the power source and the control unit so as to provide a stepped-down voltage to the control unit; and powering the control unit with the stepped-down voltage.

11. The method of claim 10 comprising the further step of powering the control unit with a back-up power supply in the event that the stepped-down voltage is insufficient.

12. The method of claim 2 comprising the further step of sending to the control unit from the network operations center over the wireless network a command selected from the group consisting of a set time zone command, an operate initialization routine command, a set warm up duration command, a set alarm voltages and bias command, a set default device state command, a set permanent scheduled events command, an on demand command, a channel override command, a configure dawn/dusk operation command, a configure dawn/dusk operation with start time command, a configure dawn/dusk operation with end time command, a set temporary scheduled event command, a delete temporary scheduled event command, a clear event configuration command, an enable/disable voltage alarm monitor message command, an acknowledge alarm message command, a clear alarm message command, a set runtime download message command, a set boot message command, a reset to default command, a status request command, a voltage reading request command, a runtime log request command, a check-sum request command, an event configuration request command, an alarm voltage request command, an event state request command, a time stamp request command, and an initialization request command.

13. The method of claim 2 comprising the further steps of:

storing daily runtime data in the control unit; and downloading the runtime data in batch form to the network operations center over the wireless network.

14. The method of claim 13 comprising the further step of initiating the download of the runtime data through the network operations center.

15. The method of claim 13 comprising the further step of programming the control unit to automatically download the runtime data to the network operations center on a regular interval.

16. The method of claim 2 comprising the further steps of:

downloading the operating protocol from the control unit to the network operations center over the wireless network; and verifying the operating protocol against scheduling information for the control unit stored at the network operations center.

17. The method of claim 2 comprising the further step of sending from the control unit to the network operations center over the wireless network a message selected from the group consisting of a boot up message, an initialization complete message, a low voltage alarm message, a saturation voltage alarm message, an off voltage alarm message, a channel voltage reading message, a device status reading message, a daily runtime download message, a runtime log message, a check-sum response message, an event configuration response message, a stored alarm voltages message, an event state download message, a time stamp download message, an initialization status download message, and a command confirmation message.

18. A method of controlling one or more electrical apparatuses wirelessly over a time-based two-way wireless network having real-time data imbedded in a signal broadcast from the wireless network at frequent regular intervals, comprising the steps of:

wiring a control unit between a power source and a set number of electrical apparatuses;

programming the control unit with an operating protocol and software code configured to acquire and utilize digital binary real-time data from the network signal;

communicating with the control unit from a host network operations center through the wireless network;

receiving and extracting at the control unit the real-time data automatically imbedded in a signal broadcast from the wireless network;

initializing the control unit so as to determine a nominal voltage of the control unit based on the number of electrical apparatuses;

keeping the real-time data in a clock circuit of the control unit as enabled by the software code residing on a microprocessor of the control unit; and controlling each electrical apparatus according to the operating protocol in conjunction with the real-time data in the clock circuit;

reading an actual operating voltage when the control unit and its associated electrical apparatuses are powered;

calculating an alert voltage change by dividing the nominal voltage by the number of electrical apparatuses; and sending a low-voltage alert message from the control unit over the wireless network to a network operations center if the operating voltage has dropped from the nominal voltage by an amount greater than or equal to the alert voltage change.

19. A system for controlling one or more electrical apparatuses by way of a time-based wireless two-way network having imbedded real-time data inherent in a signal broadcast from the network at frequent regular intervals, the signal being acquired from a first transceiver configured to acquire and relay the real-time data from a global positioning system satellite and being broadcast by a second transceiver configured to receive the real-time data from the first transceiver and to transmit the real-time data at frequent regular intervals from a local tower site in the form of an encoded time-stamp transmission embedded in a first frame of a 16- to 32-frame data header, the system comprising:

a processor/transceiver control unit connected to the one or more electrical apparatuses and having at least one microprocessor wired to a third transceiver, the microprocessor storing an operating protocol and software code, the processor/transceiver control unit further including a clock circuit, the third transceiver being configured in cooperation with the software code to receive the real-time data from the second transceiver as automatically embedded in the data header of the network signal and to then keep the real-time data in the clock circuit; and a network operations center configured to communicate with the remote processor/transceiver control unit over the wireless two-way network, the network operations center sending one or more operating protocol commands to the processor/transceiver control unit while expressly not sending any real-time data and receiving messages from the processor/transceiver control unit confirming receipt and execution of the commands, whereby the processor/transceiver control unit controls power to the one or more electrical apparatuses according to the operating protocol at real-time as kept by the clock circuit with such real-time data being acquired by the processor/transceiver control unit through the wireless two-way network by which the operating protocol commands are sent, thereby eliminating the need for a local GPS receiver at the processor/transceiver control unit or the network operations center.

20. The system of claim 19 further comprising one or more relays wired between the microprocessor and respective ones of the electrical apparatuses, each relay having an associated current transformer for monitoring the circuit amperage.

21. The system of claim 20 wherein:

multiple relays are provided on the processor/transceiver control unit such that multiple electrical apparatuses are connected to the processor/transceiver control unit; and multiple operating protocols are stored in the microprocessor corresponding to the multiple electrical apparatuses, so that each electrical apparatus is independently controlled by the processor/transceiver control unit.

22. The system of claim 19 further comprising a voltage transformer wired to an electrical apparatus power source so as to provide stepped down voltage to the processor/transceiver control unit.

23. The system of claim 22 further comprising a back-up power supply so as to provide voltage to the processor/transceiver control unit in the event that the electrical apparatus power source is down.

24. The system of claim 19 further comprising:

an enclosure housing the processor/transceiver control unit; and a visible indicator wired to the microprocessor and installed in the enclosure so as to indicate the status of the processor/transceiver control unit.

25. The system of claim 19 wherein the operating protocol is selected from the group consisting of a permanent schedule, a temporary schedule and an on-demand command.

26. The system of claim 19 further comprising:

a means for storing in the microprocessor a nominal voltage for the electrical apparatuses; and a means for reading an operating voltage for the electrical apparatuses and comparing the operating voltage to the nominal voltage so as to monitor the operation of the electrical apparatuses.

27. A device for controlling one or more electrical apparatuses comprising a processor/transceiver control unit connected to each electrical apparatus and having at least one microprocessor wired to an RF transceiver, the microprocessor storing an operating protocol and software code, the processor/transceiver control unit further including a clock circuit, the RF transceiver being configured in cooperation with the software code to receive real-time data transmitted at frequent regular intervals from a local tower site in the form of an encoded time-stamp transmission embedded in a first frame of a 16- to 32-frame data header and to keep the real-time data in the clock circuit, whereby the processor/transceiver control unit controls power to each electrical apparatus according to the operating protocol at real-time as kept by the clock circuit without the need for a local GPS receiver at the processor/transceiver control unit.

28. A device for controlling one or more electrical apparatuses consisting essentially of a processor/transceiver control unit connected to each electrical apparatus and having at least one microprocessor wired to an RF transceiver, the microprocessor storing operating protocol commands as sent from a network operations center over a time-based wireless two-way network, the processor/transceiver control unit further including a clock circuit that keeps real-time onboard, the RF transceiver and microprocessor being configured in cooperation with software code residing in the microprocessor to receive and extract real-time data automatically embedded in a signal of the wireless network broadcast at frequent regular intervals and to keep the real-time data in the clock circuit, whereby the processor/transceiver control unit controls power to the electrical apparatus according to the operating protocol commands sent from the network operations center at real-time as kept by the clock circuit with such real-time data being acquired by the processor/transceiver control unit through the wireless two-way network by which the operating protocol commands are sent, thus eliminating the need for a separate GPS receiver in the device for receiving real-time data.

29. A device for controlling one or more electrical apparatuses consisting essentially of a processor/transceiver control unit connected to each electrical apparatus, the processor/transceiver control unit consisting essentially of:

at least one microprocessor storing operating protocol commands as sent from a network operations center over a time-based wireless two-way network and further storing software code;

an RF transceiver connected to the microprocessor;

one or more relays connected between the at least one microprocessor and the one or more electrical apparatuses through one or more current transformers;

a back-up power supply connected to the microprocessor;

a voltage transformer connected between at least the microprocessor and an external power source; and a clock circuit that keeps real-time onboard, the transceiver and microprocessor being configured in cooperation with the software code stored in the microprocessor to receive and extract real-time data automatically embedded in a signal of the wireless network broadcast at frequent regular intervals and to keep the real-time data in the clock circuit, whereby the processor/transceiver control unit controls power to the one or more electrical apparatuses according to the operating protocol commands sent from the network operations center at real-time as kept by the clock circuit with such real-time data being acquired by the processor/transceiver control unit through the wireless two-way network by which the operating protocol commands are sent, thus eliminating the need for a separate GPS receiver in the device for receiving real-time data.

* * * * *